US009260917B2

(12) United States Patent
Weston

(10) Patent No.: US 9,260,917 B2
(45) Date of Patent: Feb. 16, 2016

(54) TELESCOPIC LOFT LADDER

(71) Applicant: Teletower.com Limited, Fermanagh (GB)

(72) Inventor: Richard Weston, Halstead (GB)

(73) Assignee: TELETOWER.COM LIMITED, Woodford Green, Fermanagh (GB)

( * ) Notice: Subject to any disclaimer, the term of this patent is extended or adjusted under 35 U.S.C. 154(b) by 0 days.

(21) Appl. No.: 14/400,903

(22) PCT Filed: May 13, 2013

(86) PCT No.: PCT/IB2013/053877
§ 371 (c)(1),
(2) Date: Nov. 13, 2014

(87) PCT Pub. No.: WO2013/171656
PCT Pub. Date: Nov. 21, 2013

(65) Prior Publication Data

US 2015/0144428 A1 May 28, 2015

(30) Foreign Application Priority Data

May 14, 2012 (GB) ..... 1208403.4

(51) Int. Cl.
*E06C 7/02* (2006.01)
*E06C 1/12* (2006.01)
(Continued)

(52) U.S. Cl.
CPC ..... *E06C 7/02* (2013.01); *E04F 11/068* (2013.01); *E06C 1/125* (2013.01); *E06C 1/38* (2013.01); *E06C 7/48* (2013.01); *E06C 7/50* (2013.01)

(58) Field of Classification Search
CPC ..... E06C 1/12; E06C 1/125; E06C 1/22; E06C 1/38; E06C 7/02; E06C 7/48; E06C 7/50; E04F 11/068
USPC ..... 182/195
See application file for complete search history.

(56) References Cited

U.S. PATENT DOCUMENTS 3,991,852 A * 11/1976 Brookes et al. ..... 182/169
4,049,283 A * 9/1977 Brookes et al. ..... 280/47.131
(Continued)

FOREIGN PATENT DOCUMENTS

EP 0527766 6/1996
GB 2418702 4/2006

OTHER PUBLICATIONS

International Search Report of Oct. 15, 2013 for PCT/IB2013/053877, entire document.

*Primary Examiner* — Charles A. Fox
*Assistant Examiner* — Kristine Florio
(74) *Attorney, Agent, or Firm* — Allen Dyer Doppelt Milbrath & Gilchrist

(57) ABSTRACT

A telescopic loft ladder has two stiles with sections that are telescopically collapsible within each other, rungs having lateral ends each connected to respective sections the stiles, retractable pins in the ends of the rungs for engaging holes in the stile sections to retain them in an extended position, and levers on the rungs that automatically operate when two rungs contact one another to disengage pins of the upper of the contacting rungs from the holes to permit collapse of the next higher rung. Each uppermost stile section is rotatable relative to the section connected to the uppermost rung of the ladder and has circumferentially and axially offset pin receiving holes. At least one resilient element biases the next to uppermost rung away from the uppermost rung to ensure that the locking pin of the uppermost rung engages a hole in the uppermost stile section as the ladder is lowered.

4 Claims, 2 Drawing Sheets

(51) Int. Cl.

| | |
|---|---|
| ***E04F 11/06*** | (2006.01) |
| ***E06C 7/48*** | (2006.01) |
| ***E06C 1/38*** | (2006.01) |
| ***E06C 7/50*** | (2006.01) |

(56) References Cited

U.S. PATENT DOCUMENTS

| | | | | | |
|---|---|---|---|---|---|
| D298,075 | S | * | 10/1988 | Tuggle | D34/24 |
| 5,495,915 | A | * | 3/1996 | Weston et al. | 182/195 |
| 6,345,691 | B1 | * | 2/2002 | Ruiz | 182/195 |
| 7,967,110 | B2 | * | 6/2011 | Parker | 182/77 |
| 2004/0195043 | A1 | * | 10/2004 | Johansson | 182/195 |
| 2006/0283664 | A1 | * | 12/2006 | Yao | 182/156 |
| 2009/0050407 | A1 | * | 2/2009 | Eriksson | 182/195 |
| 2010/0012433 | A1 | * | 1/2010 | Ross et al. | 182/211 |
| 2010/0270106 | A1 | * | 10/2010 | Chen | 182/195 |
| 2011/0247897 | A1 | * | 10/2011 | Nielsen | 182/195 |

* cited by examiner

TELESCOPIC LOFT LADDER

CROSS REFERENCE TO RELATED APPLICATIONS

This application is the §371 National Stage of International Application No. PCT/IB2013/053877, filed on May 13, 2013, which claims the benefit of Great Britain Application Serial No. 1208403.4 filed on May 14, 2012, the contents of which applications are hereby incorporated by reference in their entirety.

FIELD OF THE INVENTION

The present invention relates to a telescopically collapsible loft ladder.

BACKGROUND OF THE INVENTION

Collapsible ladders are known in which the stiles are formed of telescopically collapsible tubes and each rung is secured to a section of each stile. Each rung is formed with retractable pins at its opposite ends that engage in holes in the stiles to prevent the ladder from collapsing when a person is standing on one of the rungs. Manually operable levers or ring-pulls are provided to retract the pins, to allow the ladder to be collapsed one rung at a time. A disadvantage of such a ladder is that it is cumbersome and time consuming to collapse.

To overcome this disadvantage, a ladder has been proposed in EP 0527766 that is designed to collapse automatically from the bottom rung up. To collapse the ladder, pins of the lowermost rung are disengaged from the holes in the stiles to cause the whole of the ladder to drop by the height of one rung. As the lowermost rung contacts the rung above it, it releases the pins of the latter rung, causing the ladder to drop by a further rung height. This process is repeated until the whole ladder has been reduced to its minimum size.

It has further been proposed to use a ladder of the type described in EP 0527766 as a loft ladder. In this case, the top rung is pivotably attached to a rafter in the loft and a suitable stop is provided to support the weight of the ladder. For example, the stop may be part of a frame secured to a hatch door affording access to the loft.

When raised off its support, the ladder extends automatically under the weight of the ladder sections and the rungs lock into place. To collapse the ladder, the pins of the lowermost rung are disengaged from the stiles and as the lowermost rung is raised manually it disengages the pins of the next rung. Once again, continued raising of the bottom end of the ladder causes automatic release of all the stile sections one rung at a time, until the ladder is again small enough to be stowed in the loft.

Loft ladders need to be sized to suit the ceiling height and this may vary from one installation to another. The maximum height of the ladder may be varied by providing a greater or lesser number of rungs but the height between rungs is fixed and on some occasions the desired height may not be a whole number multiple of the distance between rungs.

To allow a ladder to be installed to suit differing ceiling heights, the present applicants have considered making the uppermost section of each stile rotatable relative to the section connected to the uppermost rung of the ladder and to form pin receiving holes in the uppermost section of each stile that are circumferentially and axially offset from one another.

The pins of the uppermost rung of the ladder will engage within the first holes in the uppermost stiles when the ladder is lowered. If the uppermost stile sections have holes that are circumferentially and axially staggered, it is possible during installation to set the effective length of the uppermost stile sections by rotating them, this having the effect of varying the distance travelled by the uppermost rung before its pins encounter holes in the stiles.

A loft ladder constructed in this manner suffers, however, from a problem in that if the uppermost rung is still in contact with the rung beneath it as it slides relative to the uppermost sections of the stiles, its pins will be in their retracted position, and will not engage with any of the holes in the uppermost stile sections, the upper ends of which are secured to the loft. The entire ladder therefore risks separating from the uppermost stile sections.

SUMMARY OF THE INVENTION

With a view to mitigating the foregoing problem, there is provided in accordance with the present invention a telescopic loft ladder having two stiles each comprising sections that are telescopically collapsible within each other, rungs having two lateral ends each connected to a section of a respective one of the stiles, retractable pins in the ends of the rungs for engaging in holes in the sections of the stiles to retain the stile sections in an extended position and levers on the rungs that are automatically operated when two rungs contact one another to disengage the pins of the upper of the two contacting rungs from the holes in the stiles to permit the collapse of the next higher rung, wherein the uppermost section of each stile is rotatable relative to the section connected to the uppermost rung of the ladder and has pin receiving holes that are circumferentially and axially offset from one another and wherein at least one resilient element is provided for biasing the next to uppermost rung away from the uppermost rung.

The resilient element may conveniently comprise helical springs contained with the stiles and acting between the stile sections connected to the uppermost rung and the next to uppermost rung.

For further security, a set of circumferentially spaced holes lying in substantially the same plane normal to the axis of the stile may be provided near the lower end of each uppermost stile section, to engage with the pins of the uppermost rung should the latter fail to engage in one of the circumferentially and axially spaced holes.

BRIEF DESCRIPTION OF THE DRAWINGS

The invention will now be described further, by way of example, with reference to the accompanying drawings, in which.

DETAILED DESCRIPTION OF THE EMBODIMENT(S)

Figure 2:
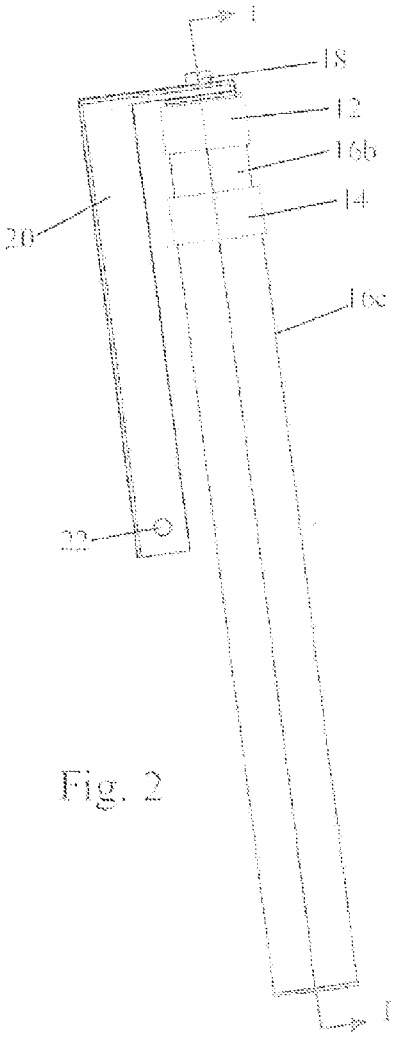
FIG. 2 shows a side view of the upper two rungs of the ladder of FIG. 1 and the bracket by means of which the ladder is mounted in a loft.

The drawings show a ladder 10 having an uppermost rung 12 and a next to uppermost rung 14 connected to sections **16*b*** and 16*c* of a telescopic stile 16 of which the uppermost section 16*a* is connected by a bolt 18 to a bracket 20. The bracket 20, as shown in FIG. 2, is in the form of an inverter "L" and is mounted in a loft for rotation about a horizontal pivot axis 22. When in a near vertical position, the ladder 10 extends through a hatch door opening to the ground and when collapsed its lower end can pass through the opening to allow the ladder to rest horizontally in the loft above the hatch door.

Figure 1:
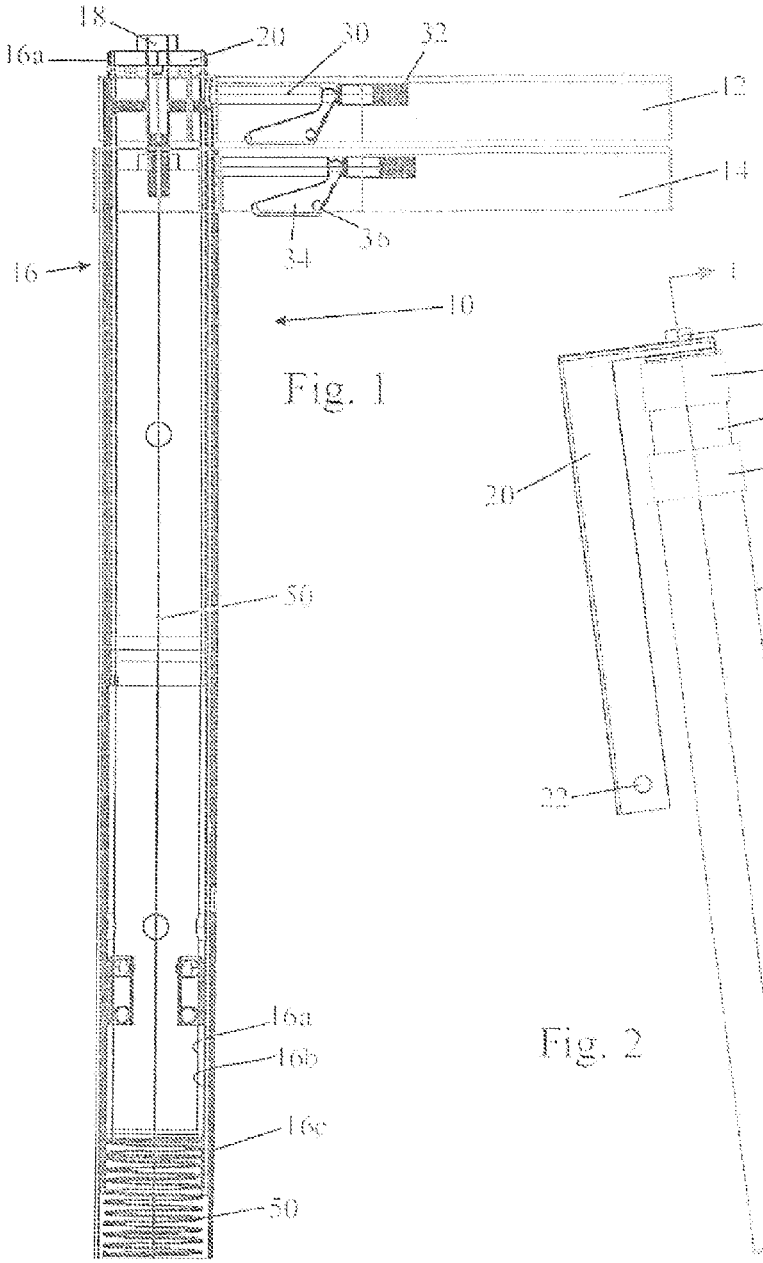
FIG. 1 is a cross section, taken along the line I-I in FIG. 2, through one of the stiles of a ladder of the invention, showing only the upper two rungs of the ladder and their stile sections when the ladder is fully collapsed.
Figure 3:
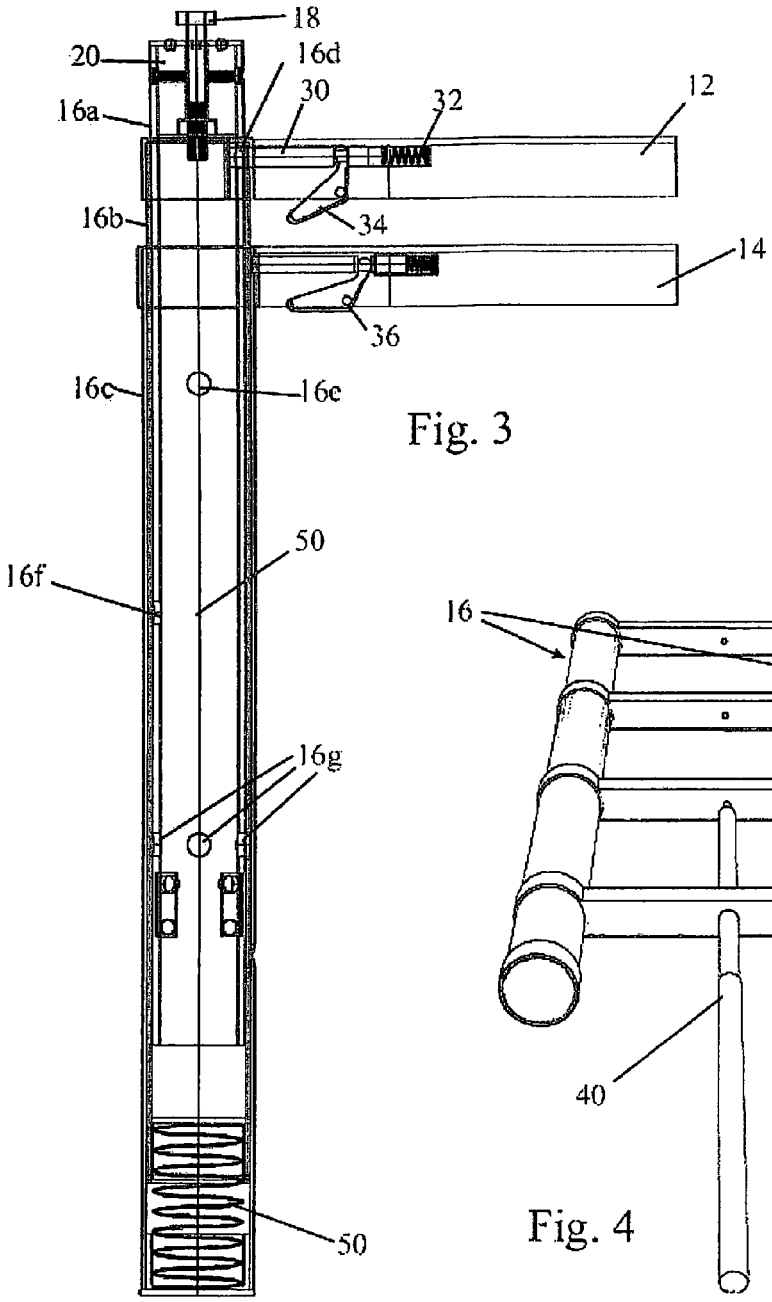
FIG. 3 is a similar section to that of FIG. 1 with the ladder partially lowered.
Figure 4:
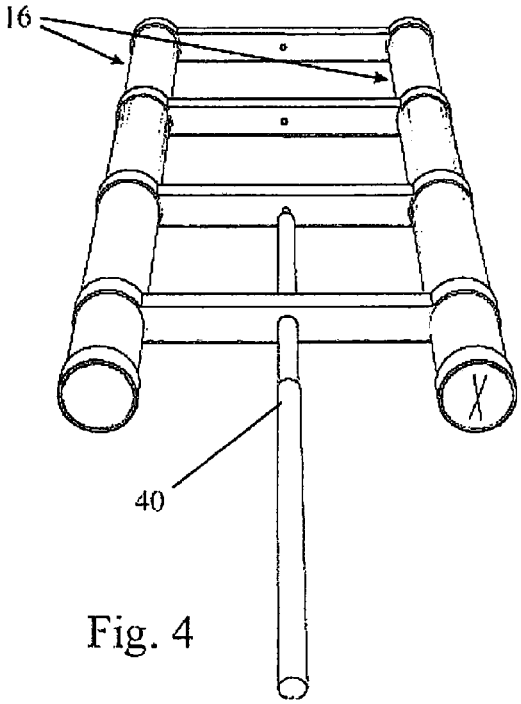
FIG. 4 is a bottom view of the ladder showing a rod that is used to lower and raise the ladder.

Each of the rungs of the ladder has at each end a locking pin 30 biased by a spring 32 and a lever 34 rotatable relative to the rung about a pivot 36 for retracting the locking pin 30 when two rungs are collapsed against one another. Thus in FIG. 1, the pins of both rungs 12 and 14 are in their retracted position whereas in FIG. 3 the pin of the rung 12 is shown in its extended locking position and the pin of the rung 14 is shown in its retracted position.

In the closed position of the ladder 10, all the locking pins 30 are retracted and the stile sections are free to slide freely relative to one another. However, when the ladder rungs are spaced from one another, the locking pins are urged by their springs 32 to their extended locking positions and they are not prevented from moving by the levers 34 which are now free to pivot downwards. Thus, when they encounter a hole in the next inner stile section, they move into and lock the stiles sections to one another.

To retract the ladder, the pins of the lowermost rung are manually retracted to release the section connected to the next higher rung. The lowermost rung can therefore now be raised until it comes into contact with the next rung. As it contacts the levers 34 of that rung, its locking pins are released allowing the lowermost rungs to be raised to contact the next rung up the ladder. This process is continued with the pins of all the remaining rungs being retracted automatically until the ladder is fully collapsed and all the pins 30 are in their retracted positions.

The raising of the ladder is effected by means of a pole 40 that passes through a hole in the lowermost rungs and engages in a recess or smaller hole in the next rung up the ladder. The pole 40 is thus securely held in the plane of the rungs of the ladder and can be use to raise the rungs or to lower them progressively.

The hatch door or a frame secured to the loft rafters is formed with a projecting bracket (not shown) in which the lower end of the ladder rests when it is fully collapsed, the bracket serving to support the full weight of the ladder. To lower the ladder, the pole 40 in inserted through the hole in the lowermost rung to engage with the next rung. The ladder is then lifted off its support bracket and as the pole 40 is lowered, the sections of the stiles extend one by one and lock into place until the lower end of the ladder rests on the floor. With all the sections of the stiles locked to one another, it is safe for a person to stand on the rungs of the ladder in order to climb into the loft space.

Unlike the case of a free standing ladder, in the case of a loft ladder the uppermost rung 12 is not permanently locked to the uppermost stile section 16*a*. Instead, its locking pins 30 are relied upon to engage in holes 16*d*, 16*e* and 16*f* in the uppermost section 16*a* as the uppermost rung 12 is lowered relative to the uppermost stile section. The holes 16*d*, 16*e* and 16*f* are axially and circumferentially spaced from one another so that by correctly orienting the uppermost stile sections 16*a* when they are bolted to the brackets 20 during installation, the extended length of the ladder may be set to suit the floor to ceiling height.

A problem that can arise, however, is that if as the ladder is lowered the rungs 12 and 14 do not separate from one another, the locking pins 30 of the uppermost rung 12 will remain retracted as the ladder is lowered and they will not engage in one of the holes 16*d*, 16*e* or 16*f*. This could cause the entire ladder 10 to separate from the uppermost stile sections 16*a* that are attached to the brackets 20.

In order to avoid such an occurrence, a spring 50 is mounted within each stile to act between the lower ends of the stile sections 16*b* and 16*c* to urge them apart. Cups may be fitted to the lower ends of these stile sections to act as abutments for the springs 50.

In this way, as soon as the weight of the ladder is raised off its support bracket and the pole 40 is lowered, the first gap to be created between adjacent rungs will be the gap between the rungs 12 and 14, thereby immediately releasing the pins 30 of the uppermost rung from their retracted position and allowing them to engage with a hole in the uppermost stile 16*a* when the first opportunity arises. Thereafter, the remaining rungs will separate from one another and their pins may lock the remaining stile sections to one another in any order, without the risk of the ladder coming away from the brackets 20.

The uppermost stile section 16*a* in the illustrated embodiment of the invention is further provided, for reasons of safety, with further holes 16*g*, each circumferentially aligned with a respective one of the holes 16*d*, 16*e* and 16*f* but all lying in a common plane normal to the longitudinal axis 50 of the stile 16 near the lower end of the uppermost stile section 16*a*. These additional holes are to engage with the pins 30 of the uppermost rung if, on account of a malfunction, they fail to engage with one of the holes 16*d*, 16*e* or 16*f*.

The invention claimed is:

1. A telescopic loft ladder comprising:

two stiles each including sections that are telescopically collapsible within each other;

rungs having two lateral ends each connected to a section of a respective one of the stiles;

retractable pins in the ends of the rungs for engaging in holes in the sections of the stiles to retain the stile sections in an extended position; and levers on the rungs that are automatically operated when two of the rungs contact one another to disengage the pins of an upper of the two contacting rungs from the holes in the stiles to permit the collapse of a next higher of the rungs;

wherein an uppermost section of each stile is rotatable relative to a section connected to an uppermost rung of the ladder and has pin receiving holes that are circumferentially and axially offset from one another; and wherein at least one resilient element is provided for biasing a next to uppermost rung away from the uppermost rung such that the levers on the uppermost rung are disengaged from the next to uppermost rung when the stile sections are moved to the extended position.

2. The telescopic loft ladder as claimed in claim 1, wherein the resilient element comprises helical springs contained with the stiles and acting between the stile sections connected to the uppermost rung and the next to uppermost rung.

3. The telescopic loft ladder as claimed in claim 1, wherein circumferentially spaced holes intersected by a common plane normal to a longitudinal axis of each stile are provided near a lower end of each uppermost stile section.

4. The telescopic loft ladder as claimed in claim 1, wherein a lowermost rung is provided with a hole to receive a pole engageable with a next to lowermost rung, in order to raise and lower the ladder.

* * * * *